US010319351B2

(12) United States Patent
Opett

(10) Patent No.: US 10,319,351 B2
(45) Date of Patent: Jun. 11, 2019

(54) DEVICE FOR PREVENTING LOOSENING OF A DRUM'S TENSION ROD

(71) Applicant: Eric Opett, Manlius, NY (US)

(72) Inventor: Eric Opett, Manlius, NY (US)

( * ) Notice: Subject to any disclaimer, the term of this patent is extended or adjusted under 35 U.S.C. 154(b) by 0 days.

(21) Appl. No.: 15/917,933

(22) Filed: Mar. 12, 2018

(65) Prior Publication Data

US 2018/0261194 A1 Sep. 13, 2018

Related U.S. Application Data

(60) Provisional application No. 62/469,561, filed on Mar. 10, 2017.

(51) Int. Cl.
*G10D 13/02* (2006.01)

(52) U.S. Cl.
CPC ..... *G10D 13/023* (2013.01); *G10D 13/027* (2013.01)

(58) Field of Classification Search
None
See application file for complete search history.

(56) References Cited

U.S. PATENT DOCUMENTS 4,206,681 A * 6/1980 Kluczynski ..... G10D 13/023 84/411 R
4,750,401 A * 6/1988 Hoshino ..... F16B 7/06 84/413
4,790,229 A * 12/1988 Hoshino ..... F16B 7/06 84/413
7,291,777 B2 * 11/2007 Chen ..... G10D 13/023 84/421
9,349,356 B2 * 5/2016 Yoshino ..... G10D 13/027
9,679,545 B1 * 6/2017 Chen ..... G10D 13/023
2006/0016319 A1 * 1/2006 Ito ..... G10D 13/023 84/411 R
2006/0207406 A1 * 9/2006 Kennedy ..... G10D 13/023 84/411 R
2008/0173157 A1 * 7/2008 Liao ..... G10D 13/023 84/421
2011/0011239 A1 * 1/2011 Stevens ..... G10D 13/023 84/413
2018/0261194 A1 * 9/2018 Opett ..... G10D 13/023

* cited by examiner

*Primary Examiner* — Robert W Horn
(74) *Attorney, Agent, or Firm* — George R. McGuire; Bond Schoeneck & King, PLLC

(57) ABSTRACT

A device for preventing loosening of a drum's tension rods is presented. The device generally includes an elongated body extending along a first axis between first and second ends and having a first opening formed therethrough adjacent the first end and along a second axis that extends perpendicular to the first axis; first and second side edges that extend in spaced relation to one another and between the first and second ends; a second opening that extends through the first side and into the first opening along a third axis that is perpendicular to the first and second axes; and a set screw that is movably installed within the second opening and can extend into the first opening.

5 Claims, 2 Drawing Sheets

DEVICE FOR PREVENTING LOOSENING OF A DRUM'S TENSION ROD

CROSS-REFERENCE TO RELATED APPLICATION

The present application relates and claims priority to Applicant's U.S. Provisional Patent Application Ser. No. 62/469,561, filed Mar. 10, 2017, the entirety of which is hereby incorporated by reference.

FIELD OF THE INVENTION

The present disclosure is directed generally to tension rods on drums and more particularly to devices to prevent drum tension rods from loosening while playing.

BACKGROUND

Drums, and particularly snare drums, include a set of tension rods that extend between the top and bottom heads of the drum and serve to tune the drum. Once at the desired tension/tuning, it is desirable that the rods not loosen, especially while playing. However, many drummers hit the drum head especially hard and when doing so, the vibration often causes the tension rods in the vicinity of the hit to loosen. This is particularly symptomatic when hitting rim shots as the additional vibration imparted to the rim will often cause the tension rod to loosen.

Various solutions have been created to combat the loosening of the tension rods. One is a lug lock that comprises a strip of metal with an opening slightly larger than a typical lug of the tension rod. The lug is passed through the opening and the strip of metal extends to and abuts or engages the rim serving to block/prevent rotation of the lug and hence tension rod. The lug lock will often come loose of the rim and rotate along with the tension rod, thus defeating its purpose.

Another solution is a tension rod designed to prevent rotation once set in position. While useful it requires complete replacement of the original drum tension rod with an after- market rod which is expensive and perhaps undesirable if the tuning effect of the after-market rod is less effective/different from that of the original rods.

Accordingly, there is a need in the art for a device that effectively prevents loosening of the tension rods and is easy to install on existing drum hardware.

SUMMARY

The present disclosure is directed to a device for preventing loosening of a drum's tension rods.

According to an aspect is a device for use on a circular shaped drum defining a circumference, a drum head that extends in a first plane, a rim that extends around the circumference of the drum, and a plurality of tension rods each of which extends along a rod axis that is perpendicular to the first plane, wherein the device prevents rotation to a drum's tension rods when installed on the drum. The device generally comprises an elongated body extending along a first axis between first and second ends and having a first opening formed therethrough adjacent the first end and along a second axis that extends perpendicular to the first axis; first and second side edges that extend in spaced relation to one another and between the first and second ends; a second opening that extends through the first side and into the first opening along a third axis that is perpendicular to the first and second axes; and a set screw that is movably installed within the second opening and can extend into the first opening.

According to an embodiment, the second side comprises a contoured region that comfortably receives a finger to permit ease of turning.

In use, the device is placed such that the lug of a tension rod extends through the first opening (after the tension rod has been tuned to the desired tension). The elongated body is positioned with its second edge abutting the rim of the drum. If changing the tension of the tension rod is desired, the device can be removed from the tension rod, the first opening can be placed over the lug with the body extending radially outwardly away from the rim and the user can use it as a wrench to tighten or loosen the tension rod the desired amount. Once retuned, the device can be reinstalled on the tension rod with the second edge again abutting the rim to prevent rotation/loosening of the tension rod. The set screw can be tightened to engage the lug to further ensure the device does not inadvertently become dislodged from the lug.

These and other aspects of the invention will be apparent from the embodiments described below.

BRIEF DESCRIPTION OF THE DRAWINGS

The present invention will be more fully understood and appreciated by reading the following Detailed Description in conjunction with the accompanying drawings, in which.

DETAILED DESCRIPTION OF EMBODIMENTS

Figure 1:
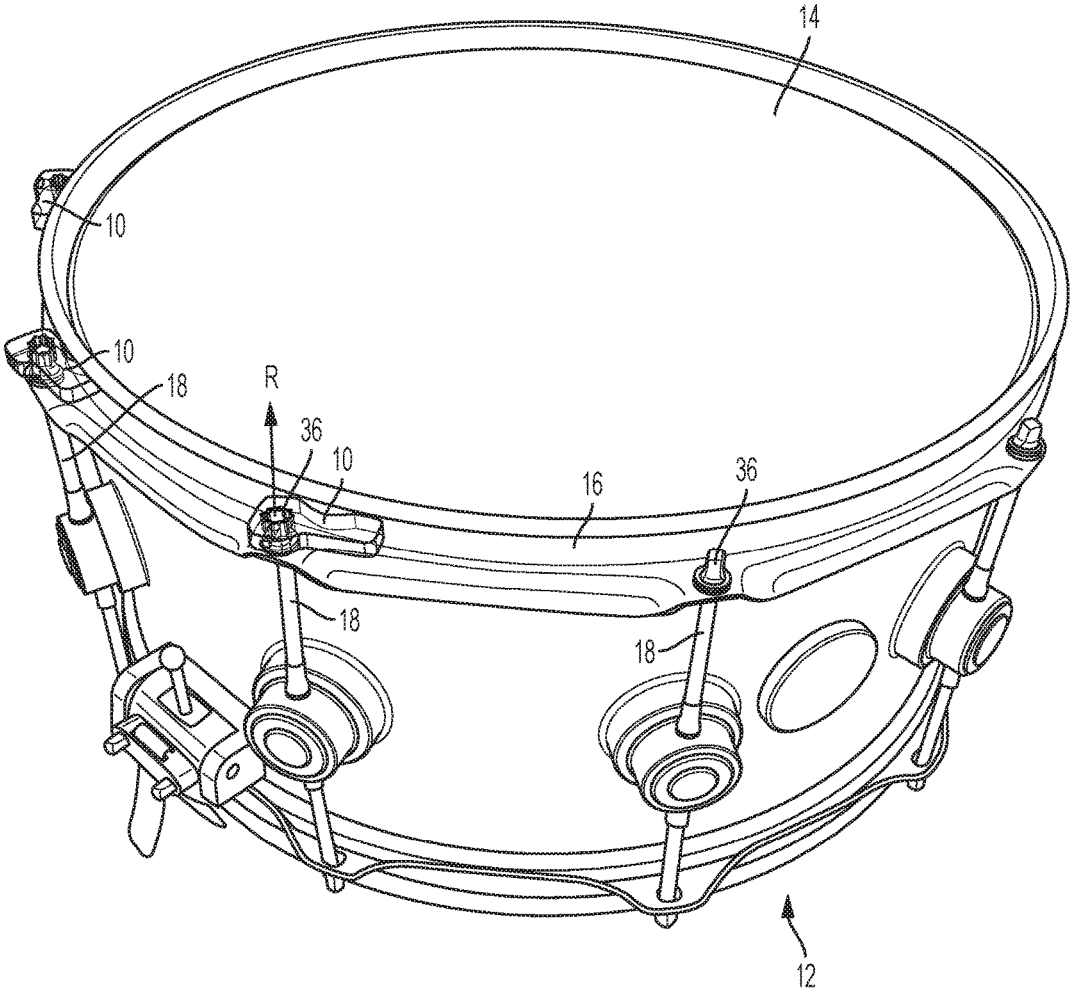
FIG. 1 is a perspective view of a device for preventing the loosening of a drum's tension rod installed on a drum, in accordance with an embodiment.
Figure 3:
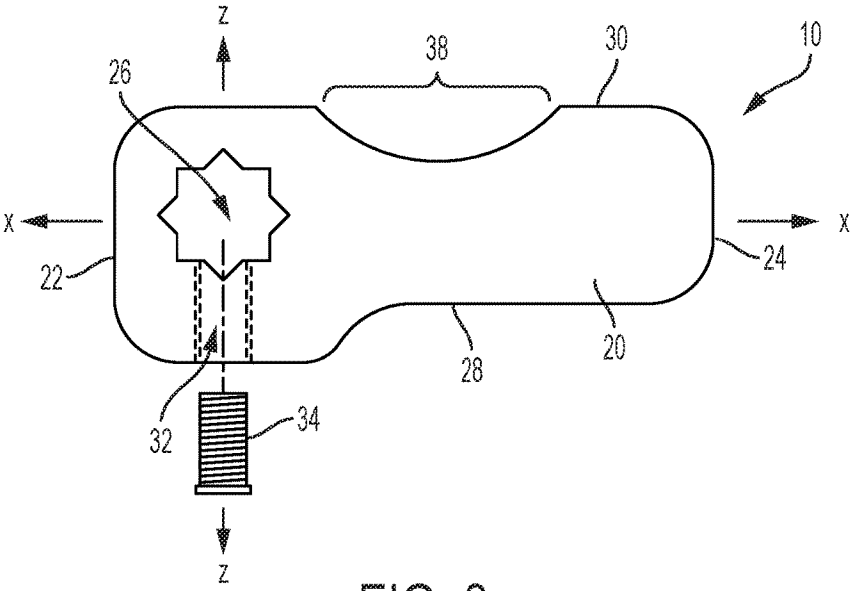
FIG. 3 is a top plan view of the device, in accordance with an embodiment.
Figure 4:
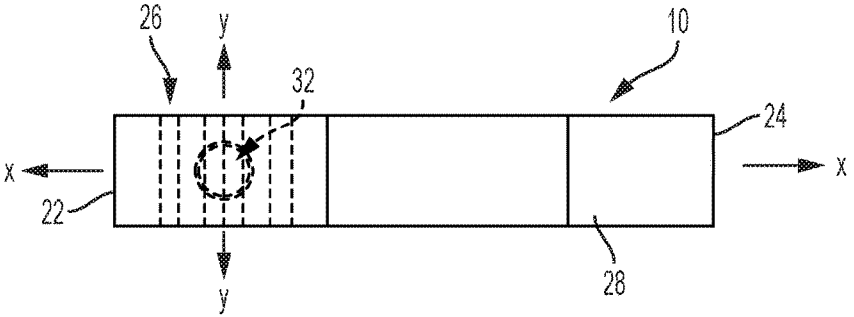
FIG. 4 is a side elevation view of the device, in accordance with an embodiment.
Figure 2:
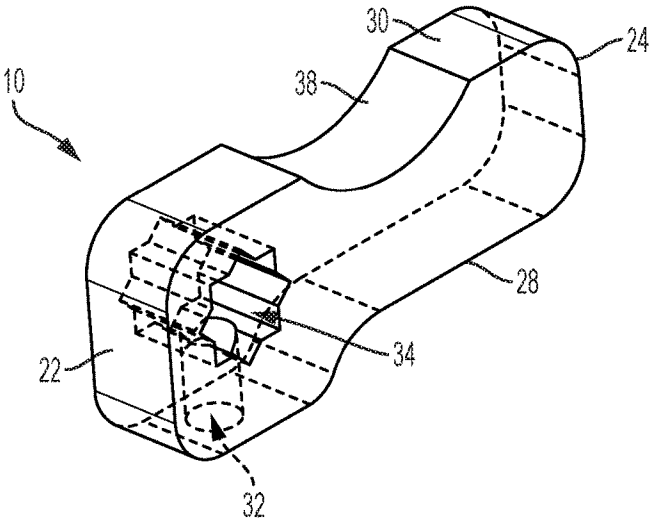
FIG. 2 is a perspective view of the device, in accordance with an embodiment.

The present disclosure describes a device, designated generally by reference numeral 10, for use on a circular shaped drum 12 defining a circumference, a drum head 14 that extends in a first plane, a rim 16 that extends around the circumference of the drum 12, and a plurality of tension rods 18 each of which extends along a rod axis R-R that are perpendicular to the first plane, wherein the device 10 prevents rotation to a drum's tension rods 18 when installed on the drum 12.

Device 10 comprises an elongated body 20 extending along a first axis X-X between first and second ends 22, 24; a first opening 26 (shaped as a star or other non-circular shape to permit it to effectively grip a lug head) formed through body 20 adjacent the first end 22 and along a second axis Y-Y that extends perpendicular to first axis X-X; first and second side edges 28, 30 that extend in spaced relation to one another and between first and second ends 22, 24; and a second opening 32 that extends through first side edge 28 and into first opening 26 along a third axis Z-Z that is perpendicular to first, X-X, and second, Y-Y, axes; and a set screw 34 that is movably installed within second opening 32 and is extendable into first opening 26 (where it can engage the lug 36 that is on the top of tension rod 18). Set screw 34 secures the connection of device 10 to drum 12 and prevents it from inadvertently coming loose from the tension rod 18. An Allen key or other conventional wrenching device can be used to move set screw 34.

To install device 10, the intent is to place one over each lug 36 on drum 12. A lug 36 is passed through opening 26 once tension rod 18 is at its desired tension. Body 20 is aligned such that axis X-X runs tangentially to the circumference of drum 12 with second side edge 30 abutting rim 16. Once installed, set screw 34 can be adjusted such that it extends into engaged relation with lug 36, thereby securing the position of device 10 on tension rod 18.

The second side edge 30 comprises a contoured region 38 that comfortably receives a finger to permit device 10 to be used as a tool to easily tighten or loosen tension rod 18. To do this, set screw 34 would be drawn back out of engagement with lug 36 and device 10 can be moved relative to tension rod such that it doesn't extend tangentially to the circumference of drum 10, but rather radially. Device 10 can then be positioned back on lug 36 and used as a wrench to rotate tension rod 18 to tighten or loosen it as desired.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A device for use on a circular shaped drum defining a circumference, a drum head that extends in a first plane, a rim that extends around the circumference of the drum, and a plurality of tension rods each of which extends along a rod axis that is perpendicular to the first plane, wherein the device prevents rotation to a drum's tension rods when installed on the drum, said device comprising:

a. an elongated body extending along a first axis between first and second ends and having a first opening formed therethrough adjacent said first end and along a second axis that extends perpendicular to said first axis, first and second side edges that extend in spaced relation to one another and between said first and second ends, and a second opening that extends through said first side edge and into said first opening along a third axis that is perpendicular to said first and second axes; and b. a set screw that is movably installed within said second opening and is extendable into said first opening.

2. The device according to claim 1, wherein said second side comprises a contoured region that is adapted to comfortably receive a finger.

3. The device according to claim 1, wherein said first opening is non-circular is shape.

4. The device according to claim 3, wherein said first opening is star-shaped.

5. A method for installing a device on a drum that defines a circumference and includes a drum head that extends in a first plane, a rim that extends around the circumference of the drum, and a plurality of tension rods each of which extends along a rod axis that is perpendicular to the first plane, and a lug mounted on each of the plurality of tension rods to permit tightening or loosening thereof, the device having an elongated body extending along a first axis between first and second ends and having a first opening formed therethrough adjacent the first end and along a second axis that extends perpendicular to the first axis, first and second side edges that extend in spaced relation to one another and between the first and second ends, and a second opening that extends through the first side edge and into the first opening along a third axis that is perpendicular to the first and second axes, and a set screw, the device adapted to prevent loosening of the tension rods when playing the drum, the method comprising the steps of:

a. tightening each tension rod to a desired degree;

b. positioning the device on the drum such that a lug extends through the first opening and the second side edge extends tangentially to the circumference of the drum; and c. tightening the set screw in the second opening to secure the positioning of the device on the lug.

* * * * *